US005582126A

United States Patent [19]

Rypinski

[11] Patent Number: 5,582,126

[45] Date of Patent: Dec. 10, 1996

[54] MODULAR WATERCRAFT SYSTEM

[76] Inventor: Donald F. Rypinski, 2915 Red Hill Ave., Suite G-103, Costa Mesa, Calif. 92626

[21] Appl. No.: 430,496

[22] Filed: Apr. 28, 1995

[51] Int. Cl.[6] ..... B63B 7/04

[52] U.S. Cl. ..... 114/352; 114/61

[58] Field of Search ..... 114/61, 123, 106, 114/162, 165, 352–354

[56] References Cited

U.S. PATENT DOCUMENTS

| | | | |
|---|---|---|---|
| 2,107,303 | 2/1938 | Ljungstöm | 114/106 |
| 3,744,071 | 7/1973 | Bosler Jr. | 114/352 |
| 4,562,784 | 1/1986 | Lineback | 114/165 |
| 4,582,011 | 4/1986 | Logan | 114/61 |
| 4,664,049 | 5/1987 | Mourgue et al. | 114/61 |
| 5,038,694 | 8/1991 | Yamoda et al. | 114/61 |

FOREIGN PATENT DOCUMENTS

| | | | |
|---|---|---|---|
| 2620420 | 3/1989 | France | 114/61 |
| 680775 | 12/1962 | Italy | 114/123 |
| 6700760 | 7/1967 | Netherlands | 114/61 |

*Primary Examiner*—Edwin L. Swinehart
*Attorney, Agent, or Firm*—Walter A. Hackler

[57] ABSTRACT

A modular watercraft system includes large and small hulls, and a variety of connectors for enabling the manual assembly of any one of several multi-hull watercraft, for example an outrigger, a catamaran, or a trimaran. The modular components are all designed to be lightweight and easily portable. In addition, a V-shaped transom, enabling inboard pivotal mounting of a rudder, may be provided on each large main hull for enhancing maneuverability and boater safety. Furthermore, a removable mast that is mounted for unobstructed 360 degree rotation about a mast axis may be provided.

7 Claims, 9 Drawing Sheets

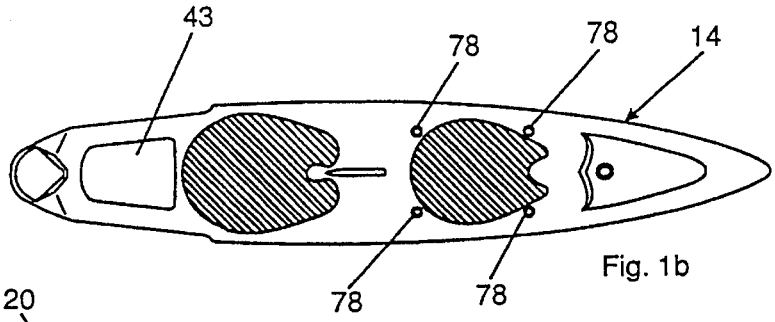
Fig. 1b
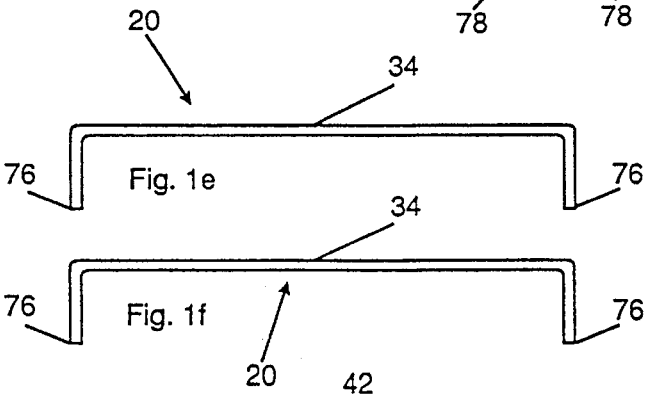
Fig. 1e
Fig. 1f
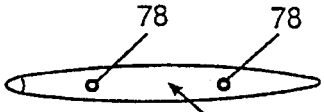
Fig. 1d
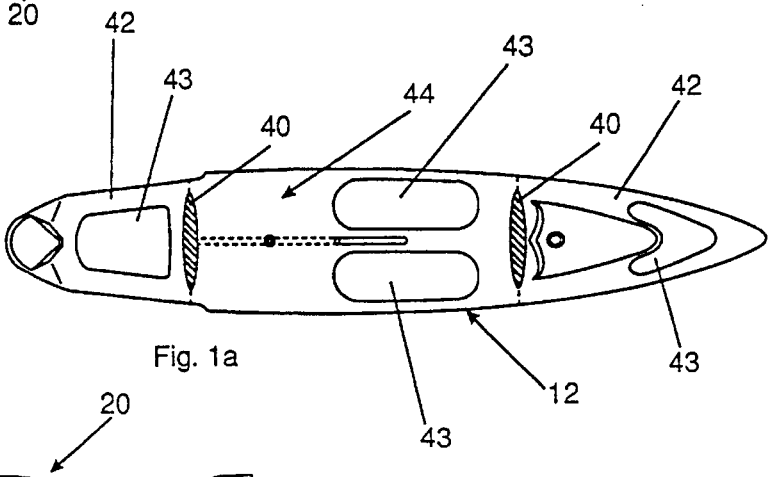
Fig. 1a
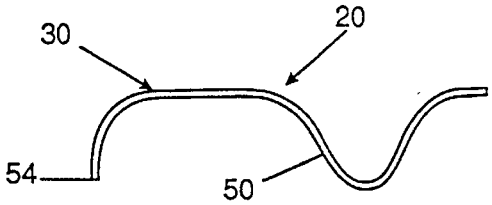
Fig. 1g
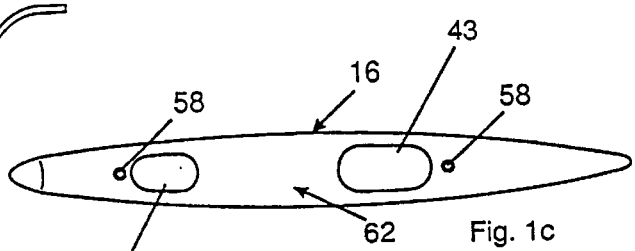
Fig. 1c
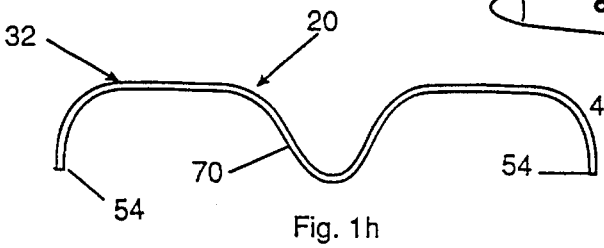
Fig. 1h

MODULAR WATERCRAFT SYSTEM

The present invention generally relates to a watercraft and particularly relates to a modular watercraft system for constructing a variety of different multi-hull boat configurations.

Watersports have become increasingly popular in recent years, and have increased in variety, particularly those designed for personal use or use by only a few individuals at a time. There has been a surge in sales of new, lightweight, car-toppable watercraft, such as sailboards, surfboards, kayaks and canoes.

The cost and limited amount of public use launch ramps and parking facilities available for a sports enthusiast may be one factor in the escalating popularity of small, portable watercraft that do not require the use of such ramps.

Unfortunately, boating still remains one of the more exclusive and expensive forms of sporting activity. Even a non-motorized boat, such as a simple sailboat or dingy, can be expensive to purchase and maintain, and usually will require ample storage space.

Most small boats tend to be cumbersome to transport and usually require the use of a trailer to do so. Boat trailers themselves are costly, and require large areas of storage space, particularly multi-hull catamaran trailers. Furthermore, trailers are subject to registration requirements under Vehicle Codes. Those who can monetarily afford to do so will often opt for dry storage of their watercraft at a public or private harbor, or for a slip or a mooring. However, fees for slips, moorings or dry storage are substantial and tend to deter people who would otherwise choose to own their own personal watercraft.

Thus, purchasing a watercraft is a major investment decision for many people. Importantly, once a watercraft, such as a kayak, sailboat or catamaran, is purchased, the owner of the boat may later desire a different type of boat to suit different water and weather conditions. For example, on a day when the air is still and there is not sufficient wind to power a sailboat, a sailboat owner may desire the use of a paddle or power boat. If not fortunate enough to own a second boat, the sailor is forced to rent a different type of boat, thus adding additional expense to his boating hobby.

Furthermore, one's desires may change, and often do, as a person becomes increasingly proficient in boating. Or possibly a sailboard owner may later aspire to obtain a craft which accommodates his wife and family. Often, a family may have several members who each prefer a different boat type. Most conventional watercraft do not lend themselves to adapting a sailboat to a paddle or power boat. There is clearly a market for a more versatile watercraft than the types available today.

Presently, there are a number of sail conversion accessories for paddle boats such as kayaks and canoes, which include sails, masts and outriggers. However, the simple addition of a sail, outrigger/s and leeboard to a boat primarily designed for paddling has considerably inferior performance compared to a genuine dedicated sailboat, particularly when sailing upwind. The present invention provides a modular system that enables the assembly of a high performance sailboat, as well as a performance paddle or (electric or gas) power boat, from common components.

Waterfront resorts commonly offer a variety of boats for rental use. A single facility may offer catamarans, rowboats, sailboards, pedal boats, kayaks and canoes. Resorts must have access to a sufficiently large stretch of shoreline or dock space in order to offer a wide selection of rental boats. The present invention enables a waterfront resort to offer a variety of boat configurations while utilizing a minimal amount of docking or storage area through the use of detachable, modular components. Thus, the shoreline may be opened for use and enjoyment of guests. Furthermore, the present modular watercraft system provides for the assembly of a number of different watercraft, each adapted to be wind driven, motor driven, paddled, rowed and/or pedal driven. This, of course, minimizes investment costs for rental facilities. Also, should damage to the watercraft occur, replacing the damaged component with another modular part, or reconfiguring it, will put the craft back into commission rather than requiring repair or replacement of the entire vessel.

Learning to sail conventional watercraft skillfully takes considerable time and practice for most people. For example, conventional sailboards require that the sail and mast be lifted from a horizontal position in the water while the user is standing on the board. Thus, the user must have considerable balance and upper body strength in order to lift the sail, which sometimes fills with water, to an upright position. Learning the sport of sailboarding can become extremely frustrating and fatiguing, not to mention dangerous if the wind shifts, the tide turns and/or the sailor becomes fatigued. The present invention eliminates most frustrations encountered by a first time sailor and enables one to safely master the craft in a fraction of the time required for conventional watercraft.

Finally, the present invention is also directed at providing a watercraft with enhanced maneuverability and user safety. Conventional boats utilize an outboard rudder pivoted at the center of the transom at the extreme end of the main hull. In order to cause the hull to turn sharply, a user must force a tiller through a considerable arc to the position of maximum steerage. Therefore, during the sharpest of turns the rudder approaches being perpendicular to the center line which creates a braking effect. The present invention provides a unique transom and rudder design that enables a sharp turn of the hull, yet eliminates the 90 degree braking effect by stopping the rudder at about 51 degrees of arc from the centerline and yet, greatly improving the turning ability of the hull over prior art transom designs and steering systems.

Notably, the present invention satisfies a long felt need for a more versatile watercraft, which is familiar to the inventor who has had over forty years of experience in building and sailing outriggers and catamarans. The concept for this type of system has been researched on a global scale, as realized by the inventor who has spent considerable time in the South Pacific, conducting extensive research on Samoan, Tahitian, Fijian, and Hawaiian watercraft, and who has over thirty years of experience designing, building and sailing high speed land sailing craft in such places as distant as the Sahara Desert, Europe and Mexico.

SUMMARY OF THE INVENTION

A modular watercraft system in accordance with the present invention generally includes a variety of modular components designed to enable manual construction, or assembly, of a plurality of different multi-hull boat configurations. In particular, a modular boat system comprises at least one large (main) hull having a bow and a transom, at least one small hull (ama), and connectors (iakos), which provide means for interconnecting the large and small hulls in order to construct a watercraft selected from the group consisting of an outrigger, a catamaran and a trimaran.

"Iako" is a Polynesian term that will hereinafter be used to generally describe several of the various connecting members utilized in the modular boat system of the present invention.

More particularly, several sets of iako connectors may be provided in order to enable the detachable coupling of hulls. For example, a user may construct an outrigger watercraft by manually coupling a small hull to a large, main hull by utilizing a set of easily attachable iako connectors. The outrigger may be modified to a trimaran configuration by utilizing an extended iako connector and attaching a second small hull. Furthermore, two hulls of the same size may be connected by a different pair of iakos to form a twin hull catamaran watercraft.

Different deck configurations may be provided on the same large main hull in order to provide, for example:

1. a sail boat that can be operated while a user is standing or sitting thereon, having watertight storage hatches in the deck, that is steered with a tiller and has a centerboard; or 2. a sail/paddle boat that can be operated while a user/and passenger is/are sitting within the deck and facing forward, similar to a two person kayak, that may be steered with the feet and has a daggerboard.

One embodiment of the present invention utilizes pivotal mounting of iako connectors such that the small hulls of the trimaran watercraft may be pivotally folded back parallel to the large hull. Thus, the hulls may be pivoted such that the trimaran may be stored or transported over land as a compact unit while remaining fully assembled. Notably, when the small hulls are extended away from one another, as when the watercraft is put to sea, each small hull bow is substantially aligned with the bow of the large hull. Such a positional relationship between the hulls maximizes the stability of the watercraft. Thus, when being transported overland or stored, the trimaran has a maximum length that is no longer than the length of the main hull. When stored, it folds to one third its maximum width.

Preferably, several hull types are made to be interchangeable with one another such that a single hull may be utilized in more than one watercraft configuration. For example, two same sized hulls may be coupled together to form a twin hull catamaran. One of the same hulls may be connected to a larger hull to form an outrigger watercraft configuration.

In addition, all hulls are constructed of lightweight materials and are compact in size, thus facilitating storage of components in small areas, and enabling a single individual to transport, assemble and launch a watercraft without need for a trailer or public launch ramp, or even the help of a crew member.

Preferably, the large main hull includes a centerboard for use when the watercraft is being utilized as a multi-hull sailboat. The centerboard is designed to be automatically retracted into the main hull when it comes in contact with a beach or is not in use. Similarly, a "kick-up" rudder is provided, as will be discussed in greater detail hereinafter. The large main hull may include a daggerboard for use when the watercraft is configured as a trimaran.

A watercraft constructed from the modular system in accordance with the present invention may be propelled by various means, such as a sail, rowing, foot pedals, or an outboard motor. For example, a sailing outrigger may be constructed utilizing a large main hull and a small hull. By changing the deck configuration of the large main hull (whereby the occupants sit inside the hull facing forward, rather than on the hull) and adding a second small hull, a paddle sailing trimaran may be constructed. Similarly, a catamaran in accordance with the present invention may include seating means for enabling one or more users to sit comfortably between the two same sized hulls and operate the watercraft by rowing. In addition, a foot pedal mechanism, disposed in an operative relationship with the seat, may be provided to enable the foot operation of the catamaran. In addition still, an outboard motor (electric or gas) may be provided to power the catamaran.

As discussed hereinabove, the present invention may include means for detachably mounting a sailing rig, (similar to that of a sailboard) to the large main hull. One embodiment of the present invention provides a mast mounting system that is designed for safely enabling an inexperienced sailor to learn proper sailing techniques, while providing a highly efficient sail for use by experienced sailors. In particular, the mounting of the mast to the hull enables the mast to remain upright while the watercraft is underway without external support by the user or shrouds. Therefore the mast is rotatable 360 degrees about the mast axis. Unlike a conventional sailboard, a user of the present invention does not need to lift the mast from a horizontal position to begin sailing nor support the mast in an upright position while sailing.

In addition, a sailing craft in accordance with the present invention may utilize a boomless roller furling sail, or a conventional sail with a wishbone type boom. The design of the present invention allows for the mast and sail of either type of rig to rotate 360 degrees without obstruction thus enabling a user to easily "spill" the wind and quickly reduce speed of the watercraft when a dangerous maneuver is required, or when docking safely downwind.

One of the most original design concepts of the present invention provides a highly effective "sweep" rudder and tiller system that offers superior steering capabilities. In particular, a rudder and tiller are mounted to a unique wedged, or V-shaped, transom at the rear of the large main hull in such a way as to minimize the braking effect of the rudder and prevent the tiller from pivoting out of reach of a user while enhancing maneuverability of the watercraft. More particularly, the rudder may be pivotally mounted at the forward most portion of the V-shaped transom, which will be hereinafter described in greater detail.

It should be appreciated that the components of the present invention enable a user to manually construct various types of watercraft of his own selection. For example, a user of the modular watercraft system may initially purchase a basic set of components (for an outrigger) and later add individual components to the original set in order to enlarge the user's available selection of watercraft (to include a catamaran or a trimaran). In other words, as a user's boating skills and interests change, or even as weather or sea conditions change, it is not necessary that an entirely new boat be purchased or rented to have more than one type of watercraft at his disposal.

BRIEF DESCRIPTION OF THE DRAWINGS

A better understanding of the present invention may be had by reference to the following description, taken in conjunction with the drawings in which:

FIG. 1 shows an embodiment of the present invention including a variety of modular components for constructing a multi-hull watercraft configuration;

DETAILED DESCRIPTION

Figure 2A:
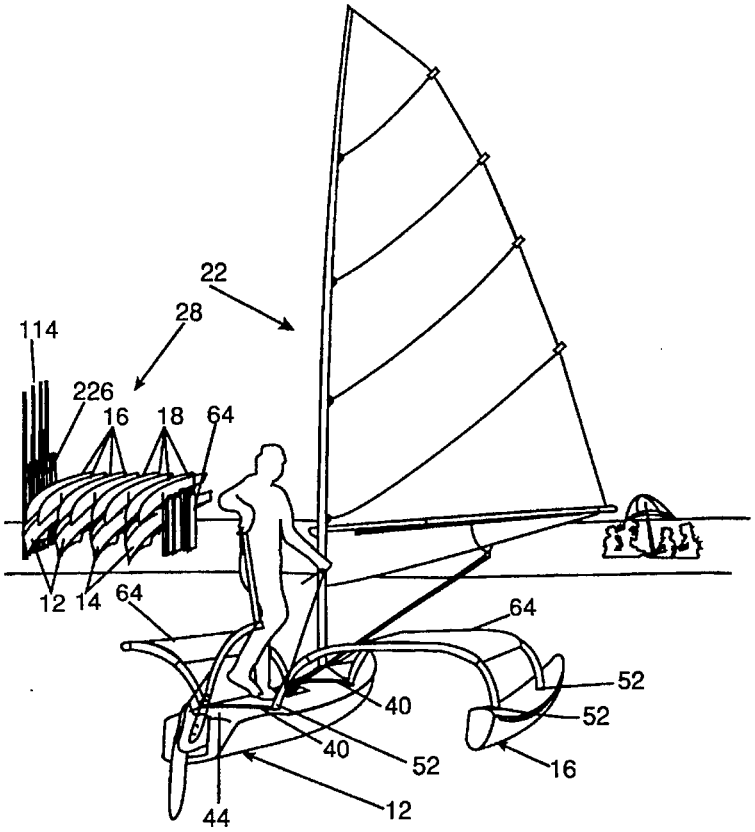
FIG. 2A is similar to FIG. 2 and shows a perspective view of a sailing trimaran watercraft constructed from selected modular components shown in FIG. 1.
Figure 2:
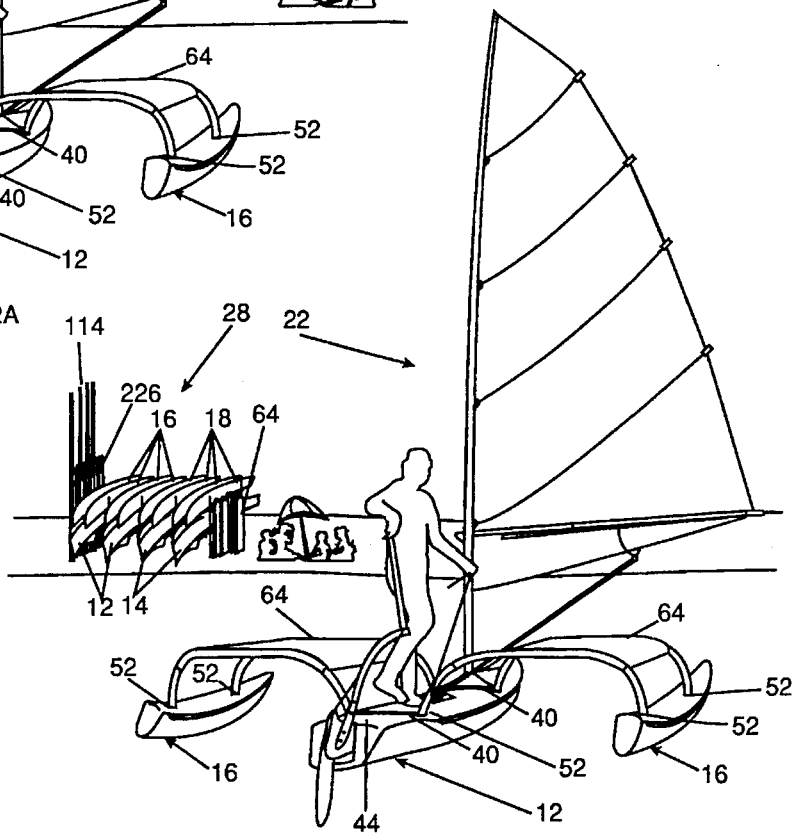
FIG. 2 shows a perspective view of a sailing outrigger watercraft constructed from selected modular components shown in FIG. 1 along with a representation of its use at a waterfront resort showing a rack for storing of components for on site assembly into one or more of a plurality of different multi-hull boat configurations upon request by a resort patron.

Referring now to FIG. 1, an embodiment 10 of a modular boat system in accordance with the present invention is shown. Particularly, the modular boat system includes at least one large "main" hull 12, 14, at least one small "ama" hull 16, 18, and means 20 for interconnecting at least one main hull 12, 14 with at least one ama hull 16, 18. (The words "main" and "ama" may hereinafter sometimes refer to a large hull and a small hull respectively.) The present invention 10 enables a user to construct a plurality of different multi-hull watercraft configurations, for example, as shown in FIGS. 2, 2A, 4, and 6 respectively, an sailing outrigger 22, a sailing trimaran 23, a trimaran paddlecraft 24, or a motorized twin hull catamaran 26. The means for interconnecting the hulls 12, 14, 16, 18 include "iako" connectors 30, 32 and 34.

Components 12, 14, 16, 18 20 of the modular boat system 10 are designed to enable easy manual assembly of a desired watercraft. For example, referring now to FIGS. 1, 2 and 3, a sailing outrigger 22 may be assembled by using a large main hull 12 and an ama hull 16.

Figure 3:
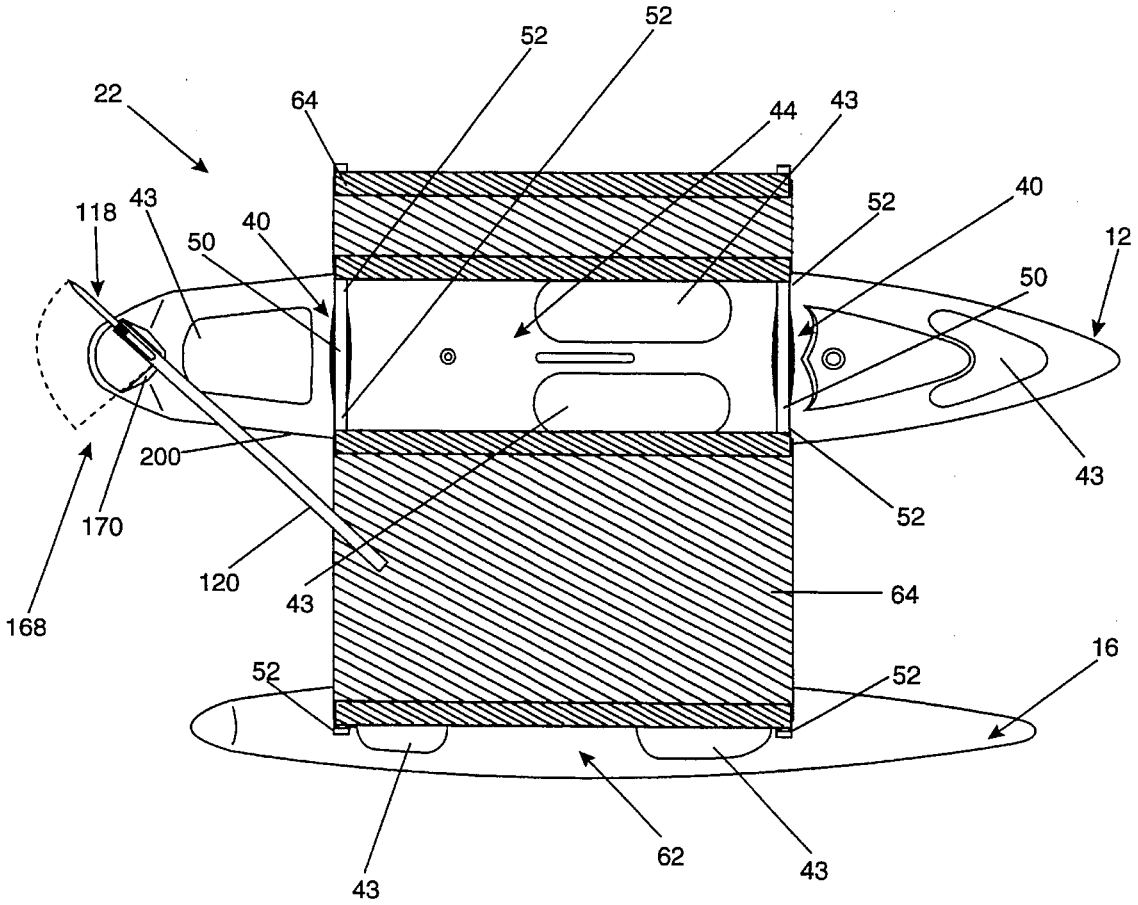
FIG. 3 shows a top plan view of the sailing outrigger watercraft shown in FIG. 2, including an original V-shaped transom in accordance with the present invention, and a rudder being pivoted for maximum steerage of the watercraft.

As hereinabove noted, components 12, 14, 16, 18, 30, 32, 34 may be stored on site, for example in a rack 28 for enabling rapid, on site, assembly of the muti-hull b oat configurations 22, 23, 24, 26 as hereinafter discussed. A pair of first connectors 30, also referred to herein as iako outrigger connectors, provide means for enabling detachable coupling of the large main hull 12 with the ama hull 16. The main hull 12 may include curved wells 40 extending laterally across the hull 12 and recessing into a deck 44. As shown in FIG. 1, the wells 40 separate the main hull 12 into three watertight compartments 42 accessible for storage purposes through watertight hatches 43. Each iako outrigger connector 30 may include a curved crossbar portion 50 as shown in FIG. 1, which may be manually dropped into a corresponding well 40 and secured to the hull 12 by, for example, a pair of pins 52 (which may be more clearly seen in FIG. 3), inserted through the iako outrigger connector 30 and the hull deck 44. Similarly, a single ama hull 16 may then be secured to a free end 54 of each iako connector 30. For example, the ends 54 may be inserted into a pair of openings 58 in the topside 62 of the ama hull 16 (See FIG. 1) and secured thereto by means of pins 52 (See FIG. 3). Preferably, as illustrated in FIG. 3, a canvas trampoline 64 provides means for furnishing a resting and operating area for a user and passengers (not shown in FIG. 3) of the watercraft 22.

It should be appreciated that another type of connector 32, (See FIG. 1) which is essentially a modified version of the iako outrigger connector 30, may be utilized to construct a trimaran watercraft 23 such as the watercraft shown in FIG. 2A, in essentially the same way as described above for the outrigger watercraft 22. More specifically, a user may construct a trimaran 23 having a main hull 12 positioned between two ama hulls 16 by interconnecting the hulls 12, 16 by means of a pair of iako trimaran connectors 32, each of which includes a curved portion 70 that is fitted into a corresponding well 40, and is secured to the hulls 12, 16 as described above, although utilizing an additional pair of pins 52.

Figure 4:
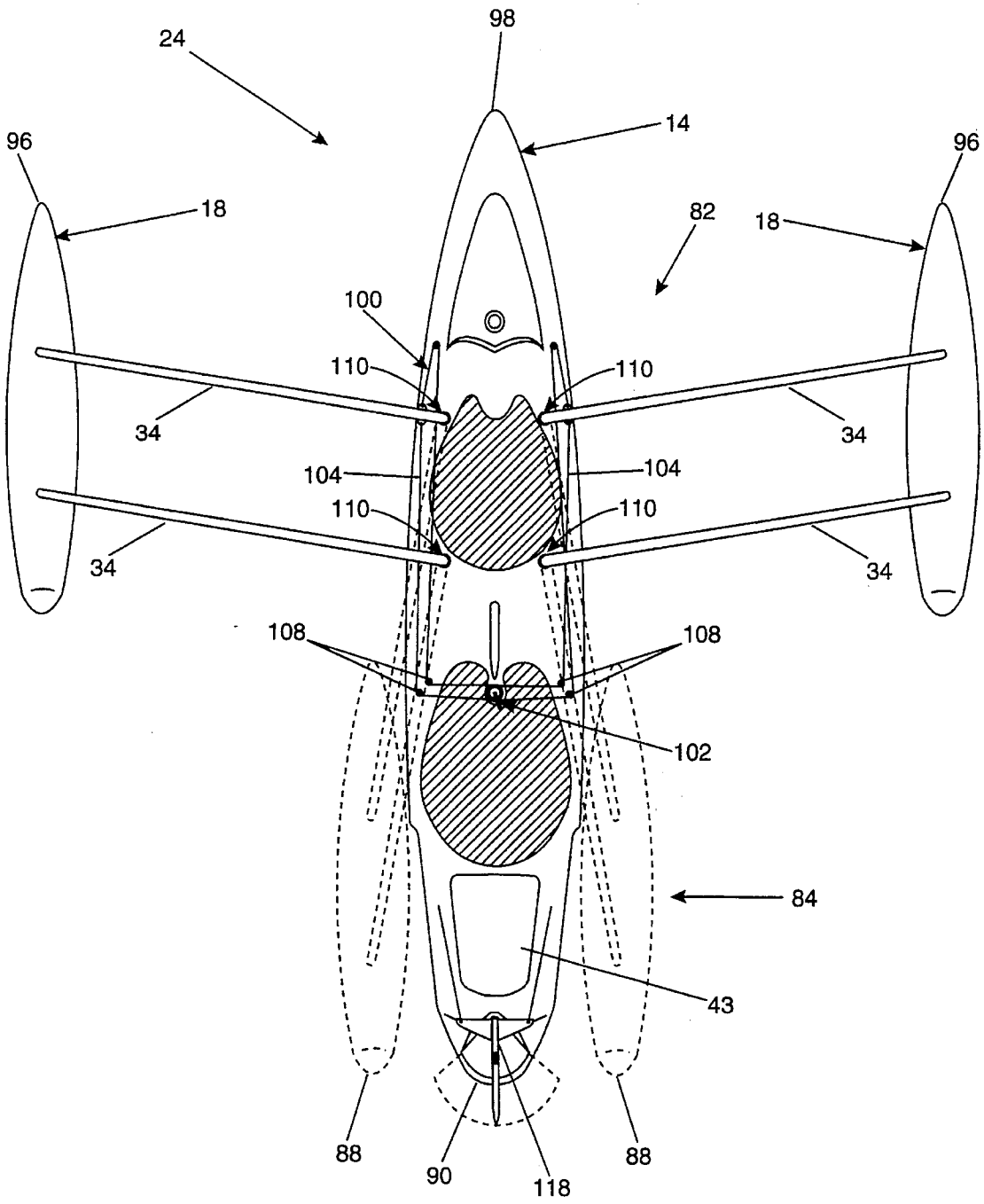
FIG. 4 shows a top plan view of a trimaran watercraft, including pivotally mounted connectors, constructed from several of the modular components shown in FIG. 1.

Alternatively, a second large main hull 14, and a second type of ama hull 18 may be utilized in the construction of the trimaran watercraft 24 shown in FIG. 4. Second connectors 34, also referred to herein as iako trimaran connectors, provide means for enabling pivotal detachable coupling of the large hull between the small hulls.

Figure 5:
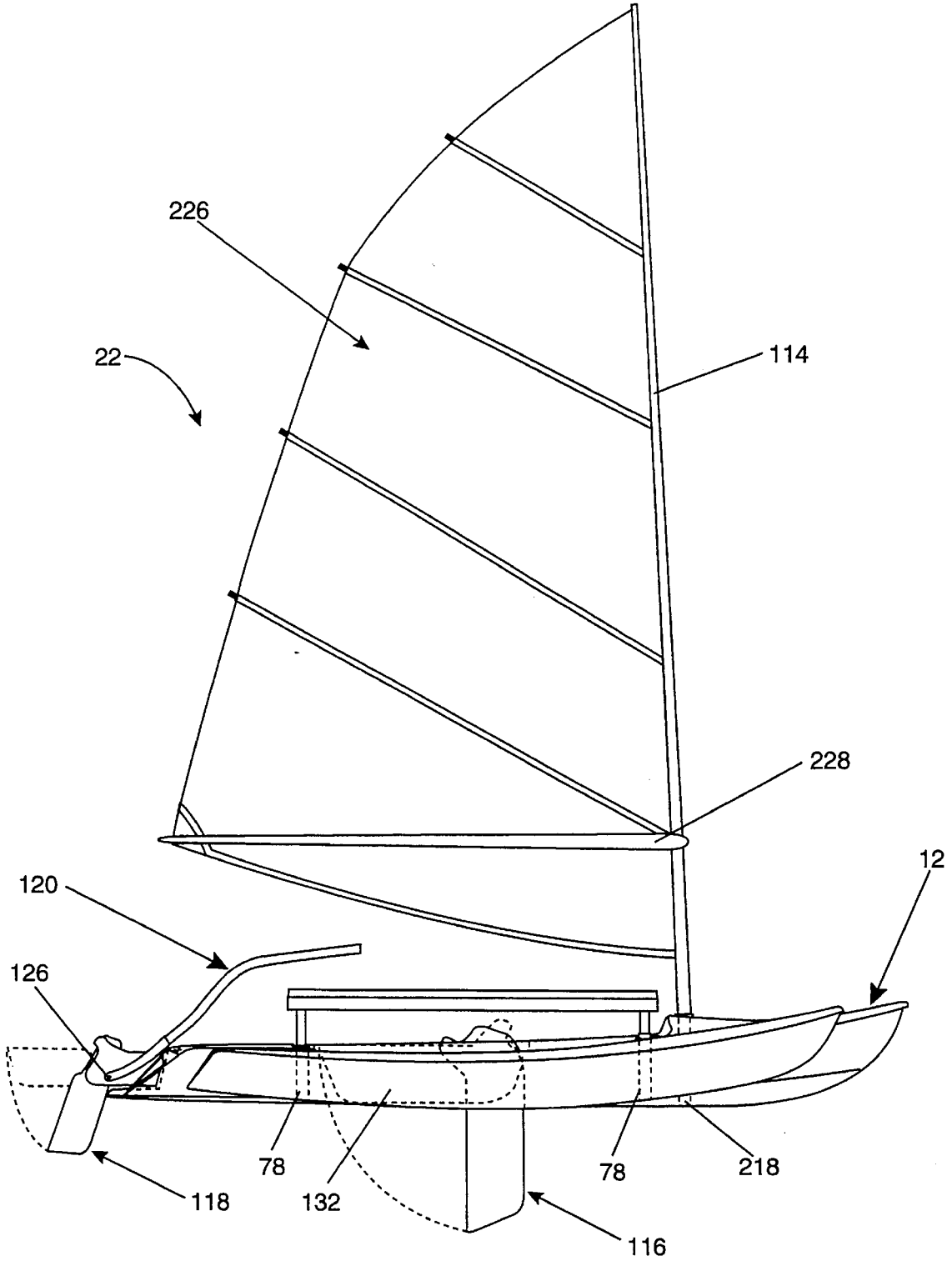
FIG. 5 shows a side view of the sailing outrigger shown in FIG. 2, including a mast mounted for 360 degree rotation about a mast axis and a sailboard type sailing rig including a wishbone type boom.

In addition, the iako trimaran connectors 34 may be pivotally mounted to the main hull 14 by, for example, vertical tubes 78 within each hull 14, 18, which provide means for receiving the connector ends 76 (See FIGS. 1 and 5). Thus, the ama hulls 18 may be pivoted from an expanded first position 82, shown in solid line, to an abutting, or folded, second position 84, shown in phantom line. Furthermore, the main hull 14 and the ama hulls 18 are sized, and the iako connectors 34 are positioned, to enable a transom end 88 of each ama hull 18 to be substantially aligned with a main hull transom 90 when the ama hulls 18 are pivoted back to minimize the width of the watercraft 24 for transporting or docking in small spaces.

When the trimaran 24 is put to sea, the ama hulls 18 are first pivoted forward away from the large main hull 14 and extended away from one another, as shown, such that the bow end 96 of each ama hull 18 is substantially aligned with a bow end 98 of the main hull 14. The alignment of the hulls 14, 18 provides stability, while the smaller size of ama hulls 18 (as compared to ama hulls 16) reduces the ama drag of the trimaran 24. Importantly, a locking mechanism 100 is provided to secure the ama hulls 14 in the expanded position 82.

For example, winches 102 may be provided for enabling a user to pull each ama hull 18 forward, by means of a taught line 104 which is then cleated or secured in a conventional manner. Further security may be had by installation of a block 108 disposed on each side of the main hull 14. The iako's 34 pivot about points 110 located on the main hull 14.

Notably, when the hulls are pivoted to the folded position 84, the trimaran 24 is quite compact. This design enhances overland transport of the trimaran 24 by eliminating the need for disassembly of the hulls. For example, the completely assembled trimaran 24 is sufficiently narrow to be mounted to the top of an automobile (not shown), thus eliminating the need for a trailer. Dry and dockside storage of the vessel 24 is also enhanced, as the length of the assembled trimaran 24 does not exceed the length of the main hull 14, which often occurs with larger trimarans.

It should be appreciated that the outrigger 22 and trimaran 23, 24 watercraft may be paddle operated, sailed or motor driven. For example, referring to the sailing outrigger shown in FIG. 5, this is accomplished by providing a means for detachably mounting a mast 114 to main hull 12, which will be discussed in greater detail hereinafter. In addition, a retractable centerboard 116, a removable rudder 118, and tiller 120, for enabling manual maneuvering of the rudder 118, are provided for use when the watercraft 22 is being sailed. The centerboard 116 may be pivotally connected to main hull 12 such that the centerboard 116 may be retracted into a trunk 132 in the hull 12 when not in use. For example, phantom line is used to show the rudder 118 and centerboard 116 both positioned for paddle operation of the outrigger 22, assuming the mast 114 has been removed therefrom. The rudder may be pivotably connected to the tiller 120 at a point 126 to also enable retraction thereof.

Figure 6:
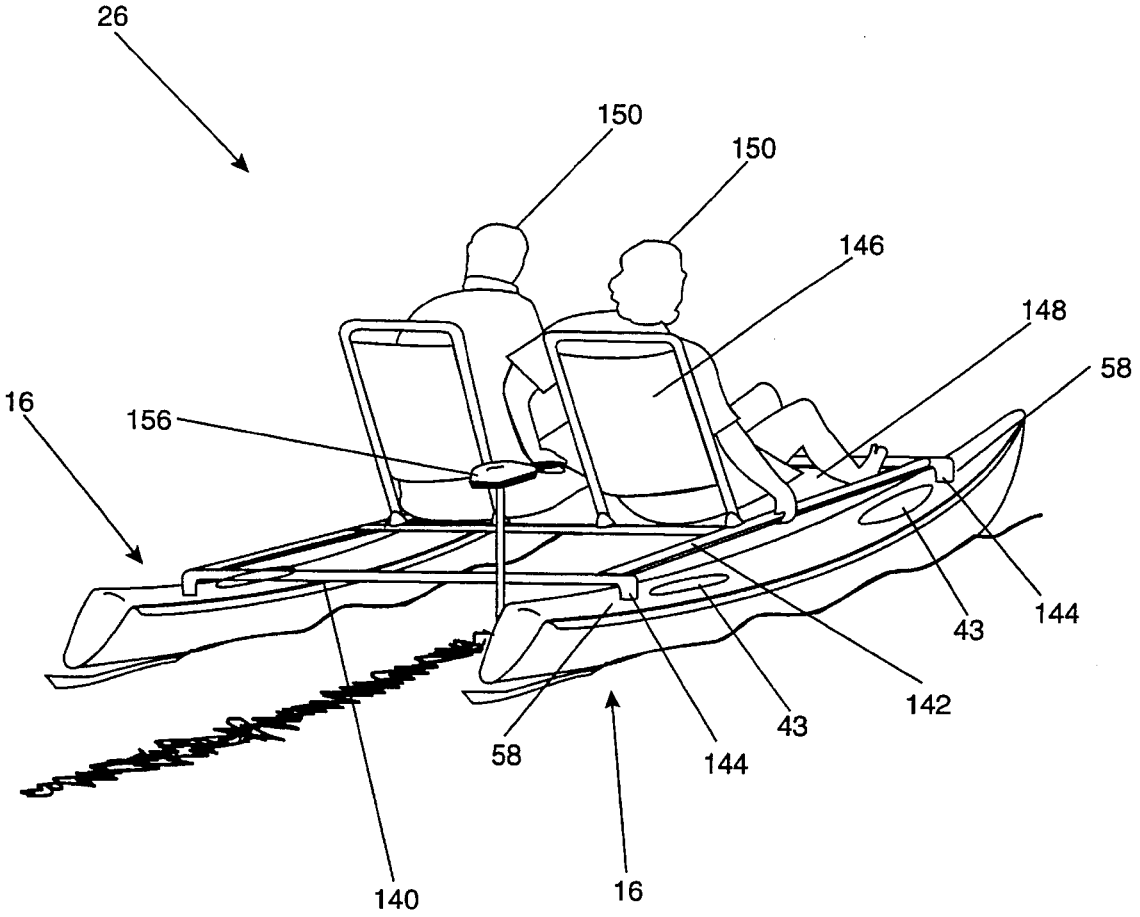
FIG. 6 shows a perspective view of a twin hull catamaran watercraft constructed from several of the modular components shown in FIG. 1 for use with an electric or gas outboard motor.

Referring now to FIG. 6, a twin hull catamaran watercraft 26 in accordance with the present invention is shown. More particularly, a pair of small hulls (amas) 16 are detachably coupled by a third connector 140, also referred to herein as a catamaran connector. The catamaran connector 140 may be comprised of a simple framework 142 having, for example, four connector ends 144 configured for detachable mounting to the two hulls 16 through openings 58 therein. In addition, canvas trampoline 146 or the like, webbed within the framework 142 may provide seating means 148 for a user and passengers 150. As discussed above regarding the outrigger 22 and trimaran watercraft configurations 23, 24, the catamaran connector 140 may be secured to the hulls 16 by means of pins, not shown in FIG. 6.

The twin hull catamaran watercraft may be rowed by means of oars (not shown), motor driven by use of an outboard motor 156, or foot pedal operated by means of a pedal mechanism (not shown), connected to a paddle wheel (not shown), disposed in operable relation to the seating means 148.

Generally, the modular hulls 12, 14, 16, 18 of the present invention may be constructed of fiberglass material and polyester resin, light weight carbon fiber, or any other suitable material. The interior of the small hulls preferably comprise foam material or the like, in order to enhance the buoyancy of the hulls. The iako connectors 30, 32, 34 and catamaran connector framework 142 may be made of formed aluminum tubing.

As hereinabove noted, watertight storage compartments 42 may be included within each large main hull 12, 14. Each large main hull 12, 14 may also include additional watertight compartments (not shown) for safety enhancement, such that buoyancy of the watercraft is maintained in the event that the hull 12, 14 is punctured or otherwise damaged.

Figure 7A:
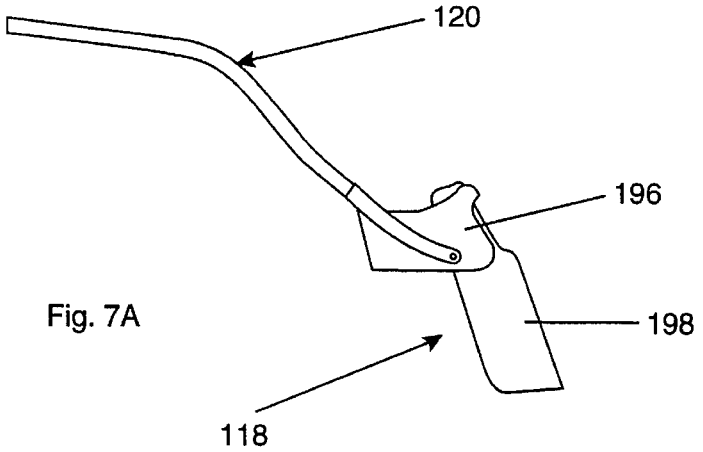
FIG. 7A shows a side view of a "kick-up" rudder for use with the V-shaped transom shown in FIG. 7.
Figure 7:
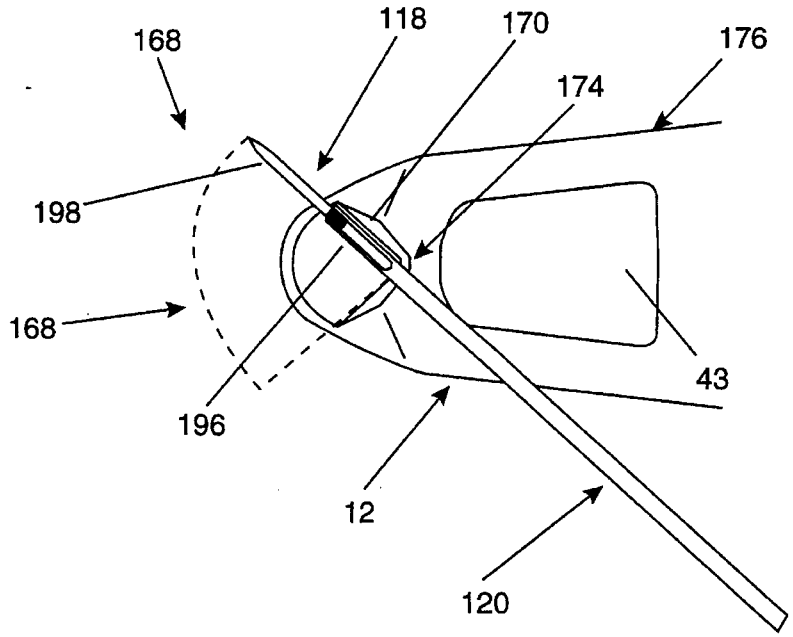
FIG. 7 shows a top view of the unique V-shaped transom's maximum steerage feature of the present invention.

Now turning again to FIG. 3, and referring as well to FIGS. 7 and 7A, another unique feature of the present invention is a transom design 168 which enhances maneuverability and increases safety of the watercraft 22. Generally, a wedge or "V-shaped" transom 168, with sides 170 disposed at an angle to one another, is provided, as well as the rudder 118, that is pivotally mounted proximate an apex, or center 174, of the V-shaped transom 168. More particularly, the overall shape of the transom 168 enables topside forward inboard mounting of the rudder 118 thereto, which enhances maneuverability of the watercraft by allowing the rudder 118 to sweep past the topside line 176 during a sharp turn of the hull 12. The sides 170 of the V-shaped transom 168 act as physical "stops" which limit the extreme positions of the tiller 120, keeping it always within reach of a user.

Figure 8:
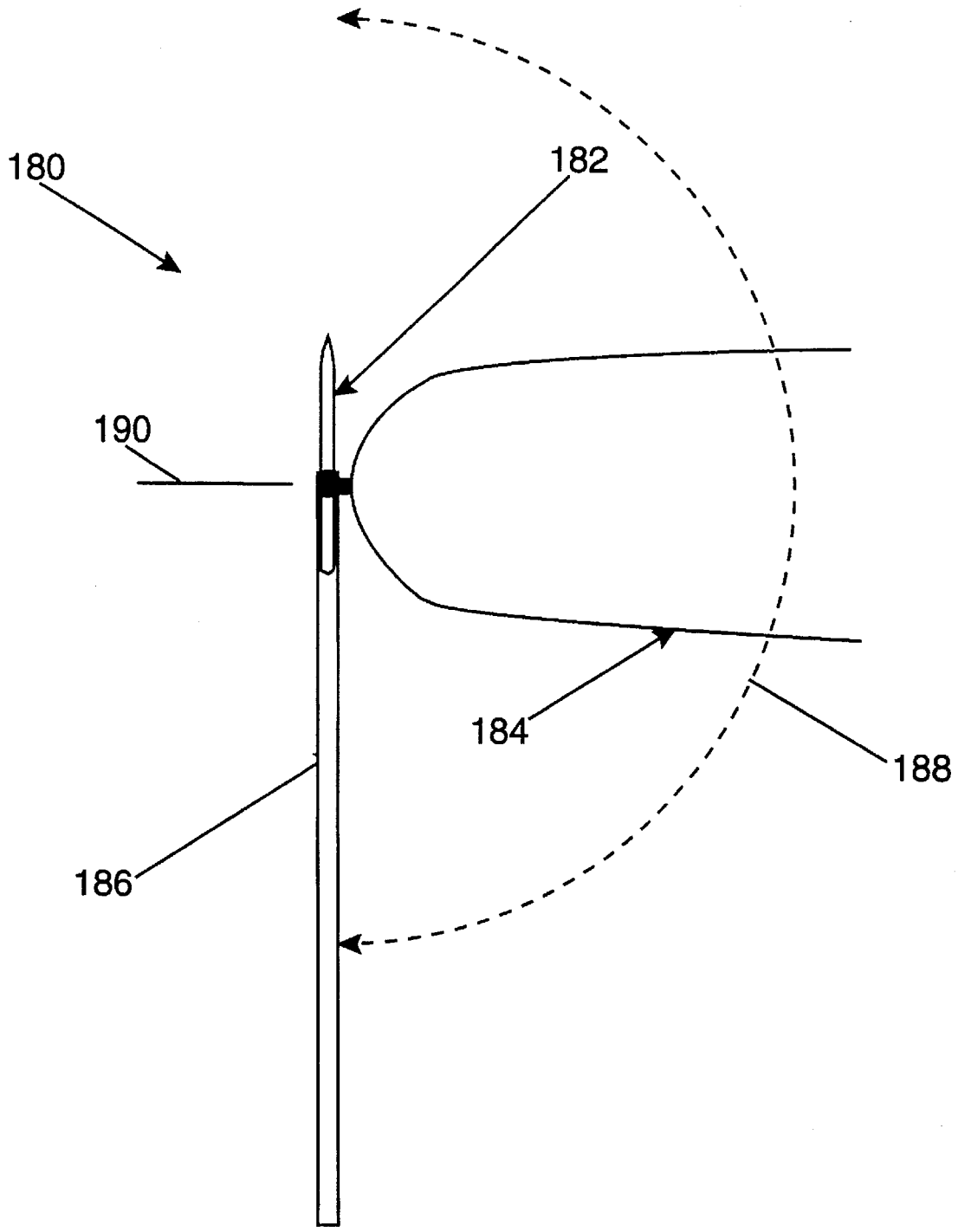
Fig. 8 (Prior Art)
FIG. 8 shows a diagram of a prior art transom including a rudder pivoted for maximum steerage of a watercraft.

The advantages of the transom design of the present invention over prior art systems may be more clearly understood with reference to the diagram of FIG. 8, which illustrates the operation of a conventional transom design 180. In general, conventional boats, particularly small sailing craft, utilize a removable transom-mounted outboard rudder 182, unlike the removable mounted inboard rudder 118 of the present invention. In order to cause the hull 184 to turn sharply with a conventional rudder, a user must force the tiller 186 through a considerable arc 188, approximately 85 degrees from the centerline 190, in order to cause the rudder 182 to reach the position of maximum steerage. When the rudder 182 is pivoted to the maximum arc 188 at the extreme end 190 of the hull 184, the conventional rudder blade 191 begins to cause a breaking effect.

Returning now to FIGS. 7 and 7A, by mounting the rudder 118 further forward within the V-shaped transom 168, the rudder 118, which may be comprised of two cheek plates 196 supporting a pivoted lower blade 198, effectively extends beyond the hull topsides 176, creating a powerful sweeping action with minimal braking during the sharpest of turns. In addition, the rudder 118 is prevented by sides 170 from pivoting to such an extreme angle that the tiller 120 extends beyond a user's reach. For example, referring now to FIG. 3, at a maximum steerage position of the rudder 118, the tiller 120 remains close to the boat line 200. Thus, the transom design of the present invention enhances boater safety while substantially improving maneuverability of the watercraft over prior art designs. Traditionally, unlike the present invention, multi-hull boats tend to stall when "coming about" in light air, which can be a potentially dangerous situation for a boater.

Figure 9:
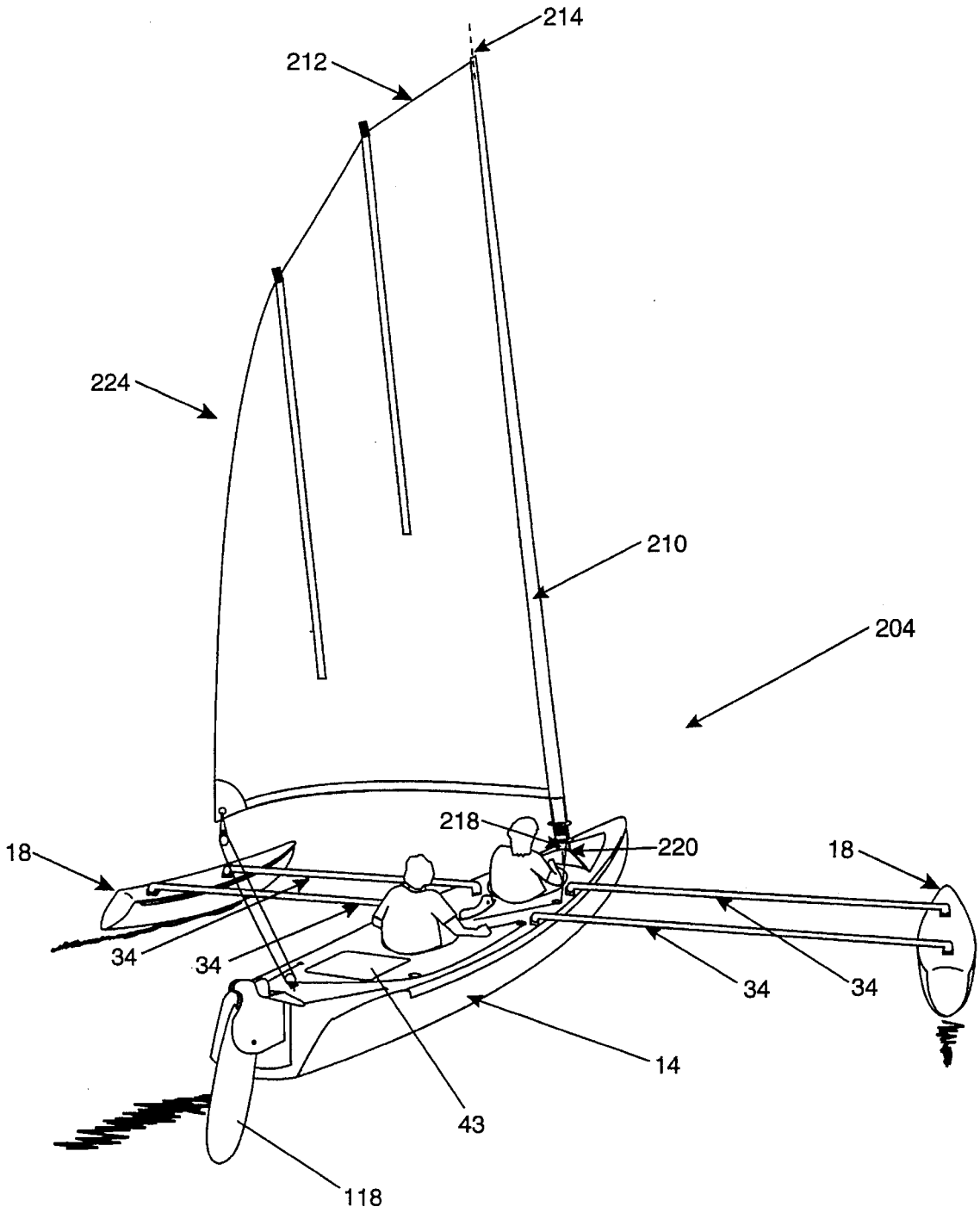
FIG. 9 shows a side view of a sailing trimaran (paddle-sailor) constructed from several of the modular components shown in FIG. 1, and including a mast, mounted for 360 degree rotation about a mast axis at a fixed raked angle to the main hull, with a roller furling type sail rig.

FIG. 9 generally shows a sailing trimaran 204 utilizing a main hull 14, small hulls 18, and iako trimaran connectors 34. Importantly, also shown is another feature of the present invention, particularly, a rotatable mast 210 and a roller furling sail 212 adapted for attachment thereto. More particularly, the mast 210 may be removably attached, or mounted, to the main hull 14 in such a way as to enable the mast 210 and a fully extended sail 212 to be rotated 360 degrees about a mast axis 214 without obstruction. Even more particularly, the mast 210 may be supported in an upright position by means of a tube 218 extending into the hull 14, said tube 218 being configured to enable a mast lower portion 220 to rotate within the tube 218. Thus, unlike a conventional sailboard rig (not shown), which is pivoted about a point of connection to the deck rather than about a mast axis, a user is not required to support the mast 210 in an upright position. The tube 218, and thus the mast axis 214, is preferably positioned at a fixed raked angle 222 to the hull 14, as shown, or may be positioned perpendicular thereto, as shown in FIG. 5.

It should be appreciated that this embodiment of the present invention provides a sail that is able to "spill" the wind quickly, thus reducing the speed of the watercraft in times of trouble. Unlike a conventional sailboard rig attachment, a user is able to release the sail at any time in order to enable the sail to rotate downwind thereby spilling the wind and reducing speed or heeling angle.

Notably, two types of sails may be utilized with this feature of the present invention, specifically, a roller furling type sail 224 with no boom, or a conventional type sail 226 with a wishbone boom 228. Both sail types 224, 226 are shown in FIGS. 9 and 5 respectively, and importantly, either may be rotated a full 360 degrees without obstruction when mounted to a main hull 12, 14 as hereinabove described. In addition, when used with a roller furling sail 224, the sail 212 may be furled by rotation of the mast 210 about its axis 214.

Although there has been hereinabove described a modular watercraft system in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A modular watercraft system for assembling a plurality of different multi-hull boat configurations, said modular watercraft system comprising:

at least one large hull having a bow and a transom with a deck extending therebetween;

at least one small hull; and means for detachably interconnecting the at least one large hull with at the least one small hull in order to enable construction of a watercraft configuration selected from the group consisting of an outrigger and a trimaran, the means for interconnecting comprising an elongate connector having a U-shaped portion therein and well means for receiving said U-shaped portion below the deck, said well means separating the at least one large hull into separate watertight compartments.

2. A watercraft comprising:

a first hull having a bow and a transom with a deck extending therebetween;

a second hull;

a rudder;

tiller means for enabling manual maneuvering of the rudder;

means for detachably mounting said rudder to the first hull transom; and means for detachably interconnecting the first hull with said second hull, the means for interconnecting comprising an elongate connector having a U-shaped portion therein and well means for receiving said U-shaped portion below the deck, said well means separating the first hull into separate watertight compartments.

3. The modular watercraft according to claim 2 wherein the large hull transom is V-shaped with sides disposed at an angle with one another, and wherein the rudder is pivotally mounted proximate an intersection of the sides of the V-shaped transom in order that the sides act as stops that prevent the tiller means from pivoting out of reach of a user, while enhancing maneuverability of the watercraft by allowing the rudder to extend past a hull topside when the tiller means is turned to a position of maximum steerage.

4. The watercraft according to claims 2 one of the first and second hulls includes seating means for enabling manual rowing of said watercraft.

5. The watercraft according to claim 2 wherein the first hull includes means for removably attaching a said thereto.

6. A watercraft comprising:

a hull, having a bow and a V-shaped transom having sides disposed at an angle to one another;

a rudder;

tiller means for enabling manual maneuvering of said rudder; and means for enabling said rudder to be detachably, pivotally mounted proximate an intersection of the sides of the V-shaped transom in order that the sides act as stops that prevent the tiller means from pivoting out of reach of a user while enhancing maneuverability of the watercraft by allowing the rudder to extend past a hull topside when the tiller means is turned to a position of maximum steerage.

7. The watercraft according to claim 6 wherein the hull includes means for removably attaching a sail thereto.

* * * * *